United States Patent [19]

Ono et al.

[11] Patent Number: 4,546,061

[45] Date of Patent: Oct. 8, 1985

[54] FILM UNIT FOR INSTANT CAMERA

[75] Inventors: Minoru Ono; Teruyoshi Makino; Hisashi Kikuchi, all of Minami-ashigara, Japan

[73] Assignee: Fuji Photo Film Co., Ltd., Tokyo, Japan

[21] Appl. No.: 666,105

[22] Filed: Oct. 29, 1984

[30] Foreign Application Priority Data

Nov. 1, 1983 [JP] Japan ..... 58-169659[U]

[51] Int. Cl.[4] ..... G03C 5/54; G03C 1/96; G03D 9/02

[52] U.S. Cl. ..... 430/207; 354/304; 430/210

[58] Field of Search ..... 430/207, 210; 354/304

[56] References Cited

U.S. PATENT DOCUMENTS 3,433,636 3/1969 Hamilton ..... 430/207

3,778,271 12/1973 Land ..... 430/207

*Primary Examiner*—Richard L. Schilling

*Attorney, Agent, or Firm*—Pasquale A. Razzano

[57] ABSTRACT

A film unit for an instant camera includes a photosensitive sheet connected with a leader sheet. A carrier sheet is partly superposed on the leader sheet and bonded thereto at one end, and a drawer member is bonded to the leader sheet, at one end, near the bonding portion between the carrier sheet and the leader sheet. The other end of the drawer member is projected outside the camera body when the film unit is loaded in the camera. An image receiving sheet to which an image formed on the photosensitive sheet is transferred, is connected to the other end of the carrier sheet. When the projecting end of the drawer member is pulled after exposure, the leading end of the leader sheet is pulled to be inserted between a pair of pressure rolls and to be projected outside the camera body by way of the bonding portion between the drawer member and the leader sheet, with the drawer member being peeled off the leader sheet thereafter. When the projecting end of the leader sheet is subsequently pulled, the photosensitive sheet is superposed on the image receiving sheet, and at the same time a developing solution bag containing therein developing solution is pinched by the pressure rolls and broken to permit the developing solution to flow between the photosensitive sheet and the image receiving sheet. The bonding portion between the drawer member and the leader sheet is of V-shape.

1 Claim, 5 Drawing Figures

FILM UNIT FOR INSTANT CAMERA

BACKGROUND OF THE INVENTION

1. Field of the Invention

This invention relates to a film unit for use in an instant camera, and more particularly to a drawer member for such a film unit.

2. Description of the Prior Art

Instant cameras have come into wide use because they enable pictures to be obtained shortly after photographing. A conventional film unit for use in the instant camera as disclosed in U.S. Pat. No. 3,433,636, for example, is shown in FIGS. 1 to 3. In FIG. 1, a photosensitive sheet 10 having a photosensitive surface 11 is connected with a leader sheet 12 at one end 10*a*. A carrier sheet 22 is partly superposed on the leader sheet 12 and is bonded thereto at one end 22*a*. Further, a drawer member 30 is bonded to the leader sheet 12, at one end 30*a*, near the bonding portion between the carrier sheet 22 and the leader sheet 12. To the other end of the carrier sheet 22 is bonded an end 20*a* of an image receiving sheet 20 having an image receiving surface 21 to which an image formed on the photosensitive surface 11 of the photosensitive sheet 10 upon exposure is trasferred when the image receiving sheet 20 is superposed on the photosensitive sheet 10 with developing solution intervening therebetween.

Generally, as shown in FIG. 2, a plurality of the film units are stacked in a casing 4 comprising a box-like body 5 and a lid 6 and loaded in a camera 1 together with the casing 4, though only a single film unit is shown in FIG. 2 for the sake of simplicity. The casing 4 is provided with a pressure plate 7 which is disposed in the casing 4 to divide the inner space thereof into two compartments. The photosensitive sheet 10 is disposed in the upper compartment between the pressure plate 7 and the body 5 of the casing, and the leader sheet 12, the carrier sheet 22 and the image receiving sheet 20 are disposed in the lower compartment between the pressure plate 7 and the lid 6 of the casing 4. The image receiving sheet 20 is placed on the lid 6 with the image receiving surface 21 facing upward (in the direction of the arrow A in FIG. 2). The carrier sheet 22 is superposed on the image receiving sheet 20, and the leader sheet 12 is placed on the carrier sheet 22. The leader sheet 12 is bent along the bight 7*a* of the pressure plate 7. Said end 22*a* of the carrier sheet 22 is bonded to the lower surface of the leader sheet 12 as viewed in FIG. 2, and the end 30*a* of the drawer member 30 is bonded to the upper surface of the leader sheet 12 as viewed in FIG. 2. The other end 30*b* of the drawer member 30 projects outside the casing 4, and when the casing 4 is loaded in the camera 1, the end 30*b* of the drawer member 30 projects outside the camera 1 through a first opening 1*a* of the camera 1 bypassing a pressure device comprising first and second pressure rolls 3*a* and 3*b*. The body 5 of the casing 4 is provided, in the upper wall thereof, with an opening 5*a* which is substantially equal to the photosensitive surface 11 of the photosensitive sheet 10 in size and through which the photosensitive surface 11 is exposed. A developing solution bag 13 containing therein developing solution is attached to the lower surface of the leader sheet 12 between its ends bonded to the carrier sheet 22 and to the photosensitive sheet 10.

When the projecting end 30*b* of the drawer member 30 projecting outside the camera 1 through the first opening 1*a* is pulled outwardly after exposure of the photosensitive surface 11 as shown in FIG. 3, the leading end 12*a* of the leader sheet 12 is inserted between the first and second pressure rolls 3*a* and 3*b* of the pressure device as drawn by the drawer member 30 by way of the bonding between the end 30*a* of the drawer member 30 and the leader sheet 12. When the drawer member 30 is further pulled, the leading end 12*a* of the leader sheet 12 is projected outside the camera 1 through a second opening 1*b* formed in the camera body below the first opening 1*a*, and at the same time, the end 30*a* of the drawer member 30 is peeled off the leader sheet 12 as the end 30*a* approaches the first or upper pressure roll 3*a* since the drawer member 30 is passed over the upper pressure roll 3*a*, whereby the drawer member 30 is taken out from the camera 1 removed from the leader sheet 12.

Thus, the leading end 12*a* of the leader sheet 12 is projected outside the camera body through the second opening 1*b* by pulling the drawer member 30. When the leading end 12*a* of the leader sheet 12 is pulled outwardly, the developing solution bag 13 is sandwiched between the leader sheet 12 and the carrier sheet 22 and is pinched by the first and second pressure rolls 3*a* and 3*b* over the leader sheet 12 and the carrier sheet 22. The developing solution bag 13 has a weak seal portion 13*a* on the side near the photosensitive sheet 10. When pressure is applied to the developing solution bag 13 by the pressure rolls 3*a* and 3*b*, the weakened seal portion 13*a* is broken and developing solution in the developing solution bag 13 flows out between the leader sheet 12 and the carrier sheet 22. As the leader sheet 12 is further pulled, the developing solution is moved into the space between the photosensitive sheet 10 and the image receiving sheet 20 pushed by the pressure rolls 3*a* and 3*b* to fill the space. The photosensitive sheet 20 is moved along the bight 7*a* of the pressure plate 7 so that the photosensitive surface 11 which originally faces upward is caused to face downward to be opposed to the image receiving surface 21 of the image receiving sheet 20 as the leader sheet 12 is pulled out. Therefore, the photosensitive surface 11 and the image receiving surface 21 are pressed against each other by the pressure rolls 3*a* and 3*b* with the developing solution intervening therebetween, whereby the image formed on the photosensitive surface 11 is transferred to the image receiving surface 21 to obtain a picture.

In the film unit described above, the bonding portion between the end 30*a* of the drawer member 30 and the leader sheet 12 must have a shear strength sufficient to resist the force exerted thereon when the drawer member 30 is pulled to move the leader sheet 12 trailing the photosensitive sheet 10 bonded thereto to project the leading end 12*a* of the leader sheet 12 outside the camera 1 passing between the pressure rolls 3*a* and 3*b*, and at the same time, must have such a peel strength that permits the end 30*a* of the drawer member 30 to be easily peeled off the leader sheet 12 when the drawer member 30 is pulled upwardly over the upper pressure roll 3*a*. That is, the force pulling the drawer member 30 initially acts substantially in the direction parallel to the leader sheet 12, and acts substantially in perpendicular to the same as the bonding portion between the end 30*a* of the drawer member 30 and the leader sheet 12 approaches the pressure rolls 3*a* and 3*b* as shown in FIG. 3. Therefore, the end 30*a* of the drawer member 30 should be bonded to the leader sheet 12 so that the leader sheet 12 can be moved rightward between the pressure rolls 3*a* and 3*b* when a rightward force is exerted on the bonding portion therebetween and so that the bonding portion can be peeled off when an upward force is exerted thereon as viewed in FIG. 3.

Conventionally, the end 30*a* of the drawer member 30 is bonded to the leader sheet 12 by means of adhesive applied at a plurality of points 41*a* to 43*a* and 41*b* to 43*b* arranged on lines parallel to the pulling direction of the drawer member 30 shown by the arraw B in FIG. 4.

This arrangement is disadvantageous in that when the drawer member 30 is pulled obliquely with respect to the direction of the arrow B, e.g., in the direction of the arrow C or D, the pulling force successively converges on one bonding point at a time and the end 30*a* of the drawer member 30 is apt to peeled off the leader sheet 12 before the leading end 12*a* of the leader sheet 12 is projected outside the camera 1. For example, when the drawer member 30 is pulled in the direction of the arrow C, the pulling force converges on the point 41*b*, and the bonding point 41*b* is first peeled. Thereafter, the bonding points 42*b* and 43*b* are peeled in this order, and finally the bonding points 41*a* to 43*a* are peeled. Accordingly, the drawer member 30 is peeled off the leader sheet 12 before the leading end 12*a* of the leader sheet 12 projects outside the camera 1 through the second opening 1*b*, thereby preventing the film unit from being taken out.

Further, when the bonding points 41*a* to 43*a* and 41*b* to 43*b* approach the pressure rolls 3*a* and 3*b* and the upward force is exerted on the bonding points 41*a* to 43*a* and 41*b* to 43*b*, the bonding points 41*a* to 43*a* on the upper line (as viewed in FIG. 4) and those 41*b* to 43*b* on the lower line cannot be peeled simultaneously unless the peel strengths of the bonding points on both lines are equal to each other. For example, if the peel strength of the bonding points 41*a* to 43*a* on the upper line is weaker than the same of the bonding points 41*b* to 43*b* on the lower line, the bonding points 41*a* to 43*a* are peeled earlier than the bonding points 41*b* to 43*b*, whereby the leader sheet 12 is pulled, by way of the drawer member 30, obliquely so that the leading end 12*a* thereof obliquely projects through the second opening 1*b*. If the obliquely projecting leading end 12*a* of the leader sheet 12 is pulled, the edges of the photosensitive sheet 10 and the image receiving sheet 20 will catch on the casing 4 to be damaged or to prevent drawing of the film unit. At the same time, the pressure rolls 3*a* and 3*b* are prevented from exerting uniform pressure, thereby adversely affecting the quality of the obtained image.

SUMMARY OF THE INVENTION

In view of the foregoing observations and description, the primary object of the present invention is to provide a film unit for an instant camera which is free from the drawbacks described above.

In accordance with the present invention, the drawer member is bonded to the leader sheet by way of adhesive applied in V-shape, the apex of the V-shape being directed in the pulling direction of the drawer member and being centered in the direction of width of the leader sheet. The shear strength of the V-shaped bonding portion is adjusted to be able to resist the tensile force exerted on the drawer member substantially in parallel to the plane of the bonding portion when the drawer member is pulled to project the leading end of the leader sheet outside the camera body, and the peel strength of the V-shaped bonding portion is adjusted to be weaker than the tensile force which is exerted on the bonding portion in the direction outside the plane of the same or in the direction of peeling the drawer member off the leader sheet.

In the film unit for an instant camera with this arrangement, when the drawer member is obliquely pulled, the shearing force exerted on the bonding portion is resisited by all of one side of the V-shaped bonding portion, whereby the drawer member is prevented from being peeled off the leader sheet. Further, when the drawer member is peeled off the leader sheet after the leading end of the leader sheet is projected outside the camera body, the peeling is initiated from the apex of the V-shaped bonding portion which is centered in the direction of the width of the leader sheet, since the apex is directed in the pulling direction of the drawer member. Therefore, the leading end of the leader sheet can be projected outside the camera body in a predetermined correct position.

DESCRIPTION OF THE PREFERRED EMBODIMENT

Figure 1:
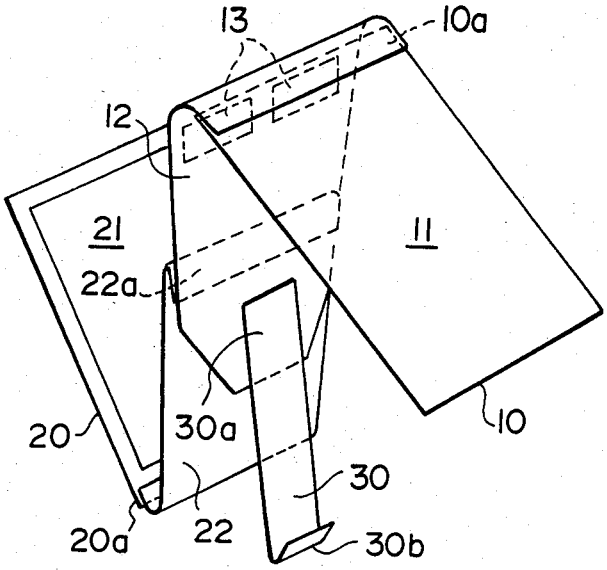
FIG. 1 PRIOR ART
FIG. 1 is a perspective view showing a film unit to which the present invention is applied.
Figure 2:
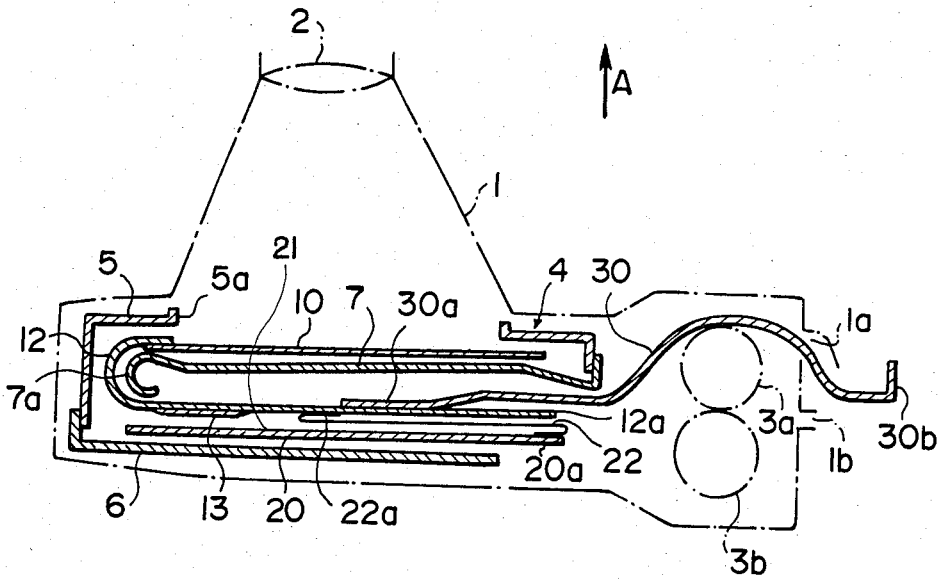
FIG. 2 PRIOR ART
FIG. 2 is a schematic cross-sectional view showing the film unit loaded in an instant camera together with a casing.
Figure 3:
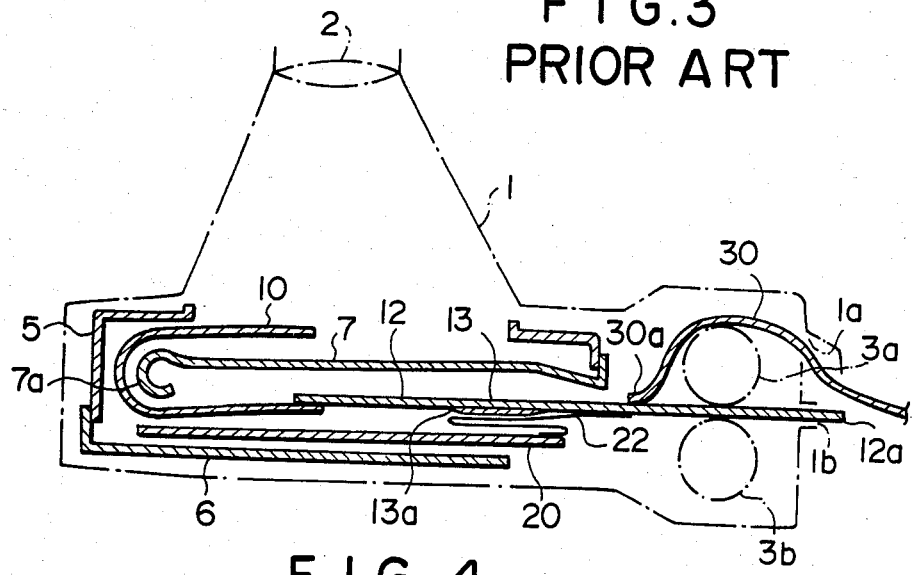
FIG.3 PRIOR ART
FIG. 3 is a view similar to FIG. 2 but showing a different state of the film unit.
Figure 4:
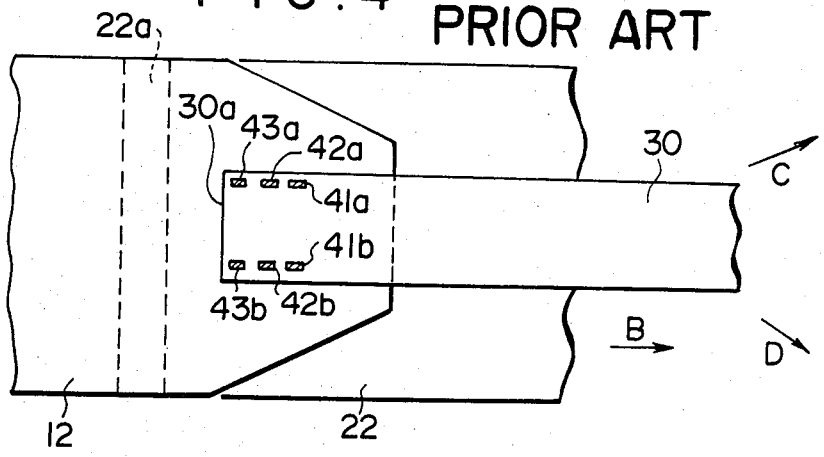
FIG.4 PRIOR ART
FIG. 4 is a fragmentary plan view showing the bonding portion between the drawer member and the leader sheet in accordance with prior art.
Figure 5:
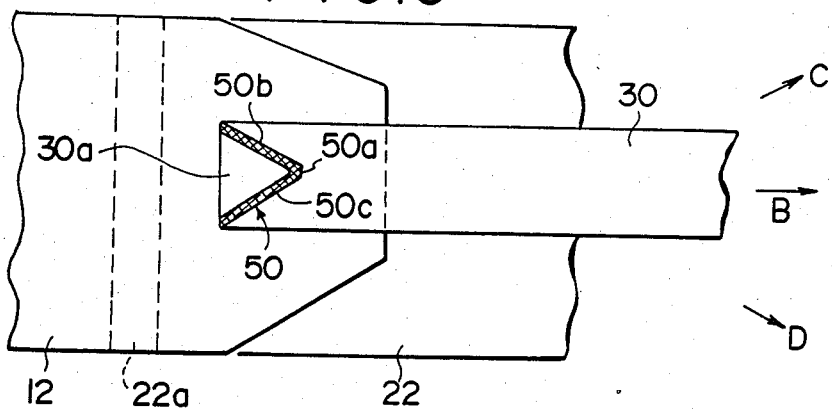
FIG. 5 is a view similar to FIG. 4 but showing the bonding portion between the drawer member and the leader sheet in accordance with an embodiment of the present invention.

FIG. 5 is a fragmentary plan view of a film unit in accordance with an embodiment of the present invention. The film unit of this embodiment is substantially the same as the conventional film unit described above in conjunction with FIGS. 1 to 4 except that the manner of bonding the end of the drawer member to the leader sheet is different from that of the conventional film unit. Therefore, in FIG. 5, the parts analogous to the parts of the conventional unit are given the same reference numerals as in FIGS. 1 to 3 and will not be described here.

As shown in FIG. 5, the end 30*a* of the drawer member 30 is bonded to the leader sheet 12, near the bonding portion between the leader sheet 12 and the carrier sheet 22, by way of adhesive applied in V-shape. In FIG. 5, reference numeral 50 denotes the V-shaped bonding portion between the end 30*a* of the drawer member 30 and the leader sheet 12, and reference numerals 50*a*, 50*b* and 50*c* respectively denote the apex and the sides of the V-shaped bonding portion.

When the drawer member 30 is pulled obliquely with respect to the correct pulling direction shown by the arrow B, for instance, in the direction shown by the arrow C or D, a tensile force acts on the side 50*b* or 50*c* of the V-shaped bonding portion 50 between the drawer member 30 and the leader sheet 12. However, unlike in the conventional film unit shown in FIGS. 1 to 4, the tensile force is counteracted by the entire side of the V-shaped bonding portion 50 which is not a point but a line, and therefore the bonding portion 50 resists peeling. The leading end of the leader sheet 12 can be thus positively projected outside the camera body upon drawing of the drawer member 30.

As pulling of the drawer member 30 is continued and the bonding portion 50 between the end 30*a* of the drawer member 30 and the leader sheet 12 approaches the pressure roll 3*a* (FIG. 3), a tensile force acting to move the end 30*a* away from the leader sheet 12 is exerted on the bonding portion 50. Since the peel strength of the bonding portion 50 is weaker than the tensile force, the end 30*a* of the drawer member 30 is peeled off the leader sheet 12. This peeling is initiated from the portion of the bonding portion 50 nearest to the pressure roll 3*a*, i.e., from the apex 50*a* of the V-shaped bonding portion 50, and since the apex 50*a* is centered in the direction of the width of the leader sheet 12, the peeling is initiated from the center of the leader sheet 12 between the longitudinal sides thereof, whereby the leader sheet 12 can be trailed straight in the direction of the arrow B even during the peeling of the bonding portion 50 between the leader sheet 12 and the drawer member 30.

We claim:

1. A film unit for an instant camera comprising a photosensitive sheet having a photosensitive surface adapted to be exposed to light to form an image of an object, a leader sheet connected to one end of the photosensitive sheet, a carrier sheet which is connected to one end of an image receiving sheet having thereon an image receiving surface to which the image of the object on the photosensitive surface is transferred, and is superposed on the leader sheet and bonded thereto, and a drawer member having a first end bonded to the leader sheet near the bonding portion between the leader sheet and the carrier sheet and a second end adapted to be projected outside the camera when the film unit is loaded therein, the leader sheet having a leading end which is adapted to be projected outside the camera body passing through a pressure device in the camera by pulling said second end of the drawer member, the photosensitive sheet and the image receiving sheet being arranged to be pressed against each other by the pressure device when they are passed through the pressure device by pulling the leading end of the leader sheet with a developing solution bag containing therein developing solution being broken to release the developing solution between the photosensitive sheet and the image receiving sheet wherein the improvement comprises that said first end of the drawer member is bonded to the leader sheet by way of adhesive applied in V-shape, the apex of the V-shape being directed in the pulling direction of the drawer member and being centered in the direction of width of the leader sheet, the shear strength of the V-shaped portion being stronger than the tensile force exerted on the first end of the drawer member when it is pulled to project the leading end of the leader sheet outside the camera body, and the peel strength of the V-shaped bonding portion being adjusted to be weaker than the tensile force exerted thereon in the direction of peeling the first end of the drawer member off the leader sheet.

* * * * *